United States Patent [19]

Wolski

[11] 3,938,443

[45] Feb. 17, 1976

[54] LOGIC MODULE

[75] Inventor: Raymond A. Wolski, New Britain, Conn.

[73] Assignee: The United States of America as represented by the Secretary of the Navy, Washington, D.C.

[22] Filed: June 17, 1974

[21] Appl. No.: 479,936

[52] U.S. Cl. ..... 102/76 P; 102/81

[51] Int. Cl.[2] ..... F42C 15/00

[58] Field of Search..... 102/76 P, 78, 79, 80, 81, 102/81.6, 83, 84, 70, 71

[56] References Cited

UNITED STATES PATENTS

| | | | |
|---|---|---|---|
| 2,446,545 | 8/1948 | McCaslin | 102/80 |
| 2,479,851 | 8/1949 | McCaslin et al. | 102/79 |
| 3,362,332 | 1/1968 | Campagnuolo | 102/81 |
| 3,362,333 | 1/1968 | Czajkowski et al. | 102/81 |
| 3,415,191 | 12/1968 | Meek et al. | 102/78 |
| 3,421,442 | 1/1969 | St. Clair | 102/81 |
| 3,498,225 | 3/1970 | Voida et al. | 102/78 |
| 3,554,128 | 2/1971 | Hoelzen et al. | 102/78 |
| 3,613,595 | 10/1971 | Blomgren et al. | 102/83 |

*Primary Examiner*—Samuel W. Engle
*Assistant Examiner*—S. A. Cangialosi
*Attorney, Agent, or Firm*—R. S. Sciascia; Roy Miller; Gerald F. Baker

[57] ABSTRACT

A logic module system comprising a plurality of cams adapted to be moved by external forces, such as ram air pistons, rate controlled springs, or the like. The cams are in contact with a spring loaded control member or plunger. Each individual cam is profiled to present a control surface to the plunger at specified time intervals or "windows." Dependent on the combined control surfaces present at any instant in time, the spring loaded plunger will respond in a prescribed manner to activate a series of mechanical elements, for example, as desired.

4 Claims, 11 Drawing Figures

LOGIC MODULE

CROSS REFERENCE TO RELATED APPLICATION

The mechanism disclosed herein is usable with the Gating Mechanism disclosed in Assignee's copending application Ser. No. 467,173 filed May 6, 1974.

BACKGROUND OF THE INVENTION

The device according to the invention is designed to control and program the operation of several mechanical elements in a predetermined manner or sequence.

More particularly, the system described is designed to position a missile fuse device in the ARMED condition or the deactivated (DUD) condition depending upon the sequence of operations sensed by the missile fuse.

When a missile is carried by an aircraft, for example, there is always the possibility that the aircraft will crash on takeoff or that the missile will otherwise be dislodged inadvertently from the aircraft. In such cases, if the missile fuse is so constructed that the departure from the aircraft will cause an ARMED condition, any loose missile will be highly dangerous. It is considered advantageous, therefore, to employ a fuse which must sense or be dependent upon several factors happening in a particular order before the missile will be ARMED.

According to the present invention, a device is provided which is dependent on the sequence of events or environmental conditions experienced by a SAFE and ARM system and the motion of an arming plunger locks the system in the SAFE or ARM condition or deactivated (DUD) condition dependent upon the time of sensing and the presence or absence of sensing or the occurrence or non-occurrence of an environmental phenomenon.

In other words, if the right combination of events are sensed in the proper sequence, the system moves from the SAFE to the ARM condition. However, if the control surface profiles of various cams moved as a result of the events are improperly presented in timed sequence or not presented at all, the status of the device goes to a locked deactivated (DUD) condition in which the missile can be safely defused.

DESCRIPTION AND OPERATION

Figure 1:
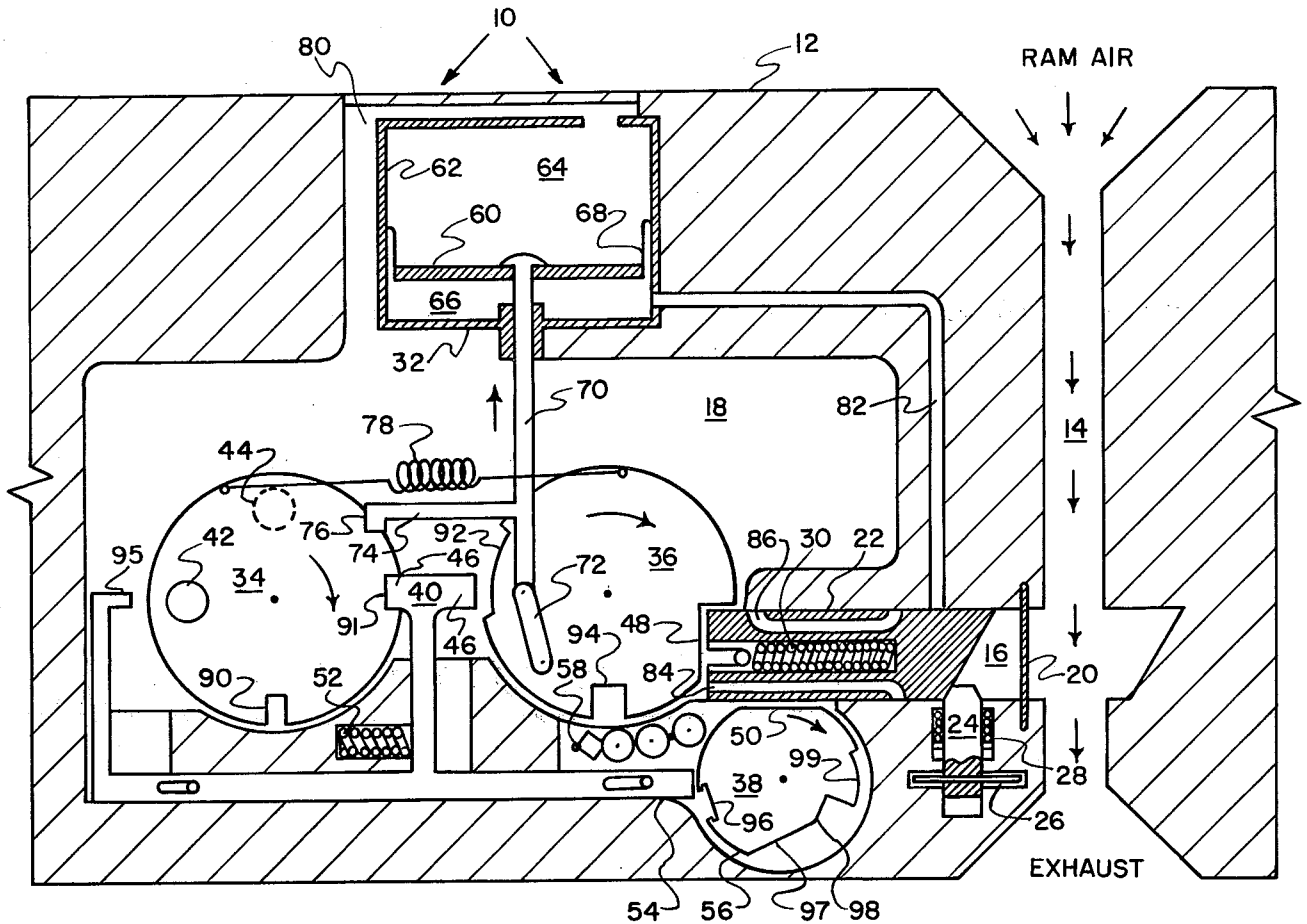
FIG. 1 is a schematic diagram of a fuse mechanism utilizing a logic module system according to the present invention showing the device in the SAFE position prior to launch.

Shown generally at 10 in FIG. 1 is a schematic representation of a missile fuse, for example, designed to use the logic module system according to the invention. The fuse consists of a housing 12 having an air passageway or duct 14 passing therethrough. The housing 12 is arranged in the missile such that one end of passageway 14 is in a high pressure area or is furnished with ram air while the other end is in a low pressure area or exhaust. A second passageway or gate valve chamber 16 is located orthogonal to the duct 14 and communicates with an inner chamber 18 containing the elements of the logic module system. During storage and at all times before operational flight of the missile, chamber 18 is hermetically sealed from air in duct 14 by means of a seal 20 of soft metal or the like across passageway 16.

The seal 20 is designed to be cut by gating valve member 22 which is closely fitted for sliding movement within valve chamber 16. This gating member 22 is held in an inactive position be means of a stop member 24 which is, in turn, locked in place by an arming wire 26. Stop member 24 is biased by a spring 28 to a position free of interference with the movement of gating member 22 and the gating member is biased toward an actuated position by means of spring 30.

Within the fuse chamber 18 there are a rotor 34, a rotor actuator 36, a timer 38, and a plunger 40 cooperating with cam surfaces on the rotor, rotor actuator, and timer.

Rotor 34 carries a primer in an opening 42 provided therein which is out of line with the detonation train indicated by the dotted circle at 44. In the position shown, rotor 34 is locked by a cam 46 on plunger 40. The rotor actuator 36 and timer 38 are both locked by portions of gating member 22. Thus, rotor actuator 36 is held from rotation by means of cutout portions 48 and timer 38 is prevented from rotation by means of flattened portion 50.

Plunger 40 is urged by spring 52 toward a position unlocking rotor 34. Movement of plunger 40 from the position shown is prevented, however, by the end 54 of plunger 40 resting on the cam surface 56 of timer 38.

The timer 38 is urged in the direction of the arrow by a spring motor (not shown) and the rate of travel is controlled through a gear train and escapement mechanism 58 in a well-known manner.

The environmental sensor in the illustrated embodiment is a fluid motor consisting of a piston 60 confined in a cylinder 62 and dividing the cylinder into two chambers 64, 66. The piston 60 is shown sealed to the walls of piston 62 by means of a rolling rubber diaphragm 68. Any differential pressure between chambers 64 and 66 will tend to move piston 60 and a piston shaft 70 is attached to piston 60 to transfer energy from piston 60 to rotor actuator 36 through a linkage 72. Shaft 70 is provided with an extension 74 which in the position shown, cooperates with a cutout portion 76 on rotor 34. With this arrangement, it is necessary for shaft 70 to move upward in the direction of the arrow beside the shaft in order for the rotor 34 to move.

Energy to move rotor 34 from its position of rest is derived only by storage of energy in spring 78 by rotation of rotor actuator 36.

Differential pressure between chambers 64 and 66 of environmental sensor 32 is accomplished by the introduction of fluid into and the exhaust of fluid from respective sides of piston 60 through passageways 80 and 82. This can only be accomplished when the gate member 22 has been moved to the position shown in FIG. 2. The two passageways 84, 86 in the gate member 22 are sealed against the walls of chamber 16 when the gating member is in the position shown in FIG. 1. Rotor 34, rotor actuator 36 and clock cam 38 have further locking surfaces 90, 92, 94, 96, 98, 100 and 102, the purpose of which will appear in the description of FIG. 2.

Figure 2:
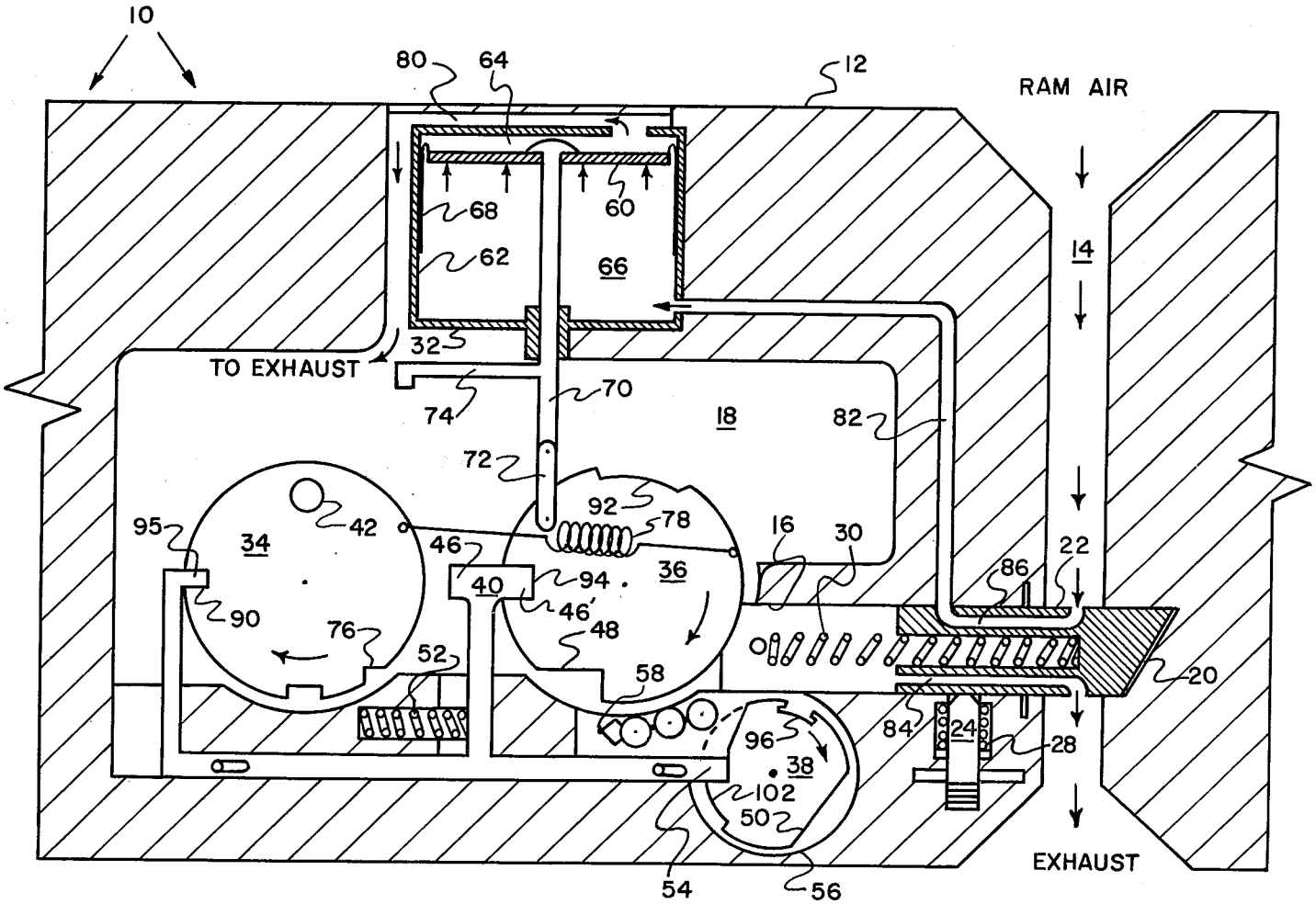
FIG. 2 is a view similar to FIG. 1 wherein the mechanism is armed and locked.

The device as shown in FIG. 2 is locked at an ARMED condition. In order to progress from the condition shown in FIG. 1 to the condition shown in FIG. 2, the first requirement was the extraction of arming wire 26 from detent stop 24. When detent 24 was biased out of valve chamber 16 by means of spring 28, the valve member 22 was urged to its extreme right hand position as shown in FIG. 2 by its compression spring 30. In its travel from the FIG. 1 position to the FIG. 2 position the gating member 22 cut through the soft metal seal 20 and the cutout portion of the seal is illustrated jammed into the recess in housing 12.

In the FIG. 2 position, gating member 22 prevents passage of air directly through duct 14 but permits air to pass through passageways 86 and 82 into chamber 66 of piston 62. At the same time passageway 84 is placed in position to exhaust air from chamber 18 and thus from passageway 80 and chamber 64. This creates a differential pressure on respective sides of piston 60 and causes the piston to move in the direction of the arrows in FIG. 2. The action of piston 60 causes movement of shaft 70 and, through link 72 causes rotation of rotor actuator 36. Rotor 36 is enabled to move because valve member 22 moved away from surface 48 of cam 36. Movement of shaft 70 also removed arm 74 from surface 76 of rotor 34 thus removing at least one barrier to rotation of the rotor 34.

Rotor 34, however, remained locked by tab 46 on plunger 40 and plunger 40 remained inactive because of the position of timer cam surface 56. But timer 38 was enabled by removal of valve member 22 from interference with surface 50 of the timer cam and the timer began moving in the direction of the arrow under the timed control of escapement 58. Initial rotation of valve actuator 36, therefore, stored energy in spring 78 tending to rotate rotor 34.

The timing of the movement of rotor actuator 36 and timer cam 38 at this time is critical. Thus if timer cam 38 advances until notch 96 is in place in front of end 54 of plunger 40 before movement of actuator cam 36, the end 54 of plunger 40 will enter the notch 96 and the cam 46' of plunger 40 will enter the notch 92 in actuator 36 (see FIG. 1). This condition will lock the mechanism resulting in a DUD.

When a pressure differential is formed and rotor actuator 36 begins to move before clock cam 38 has presented notch 96 to the end 54 of plunger 40, the cam 46' will ride on the outer periphery of the cam surface of actuator 36 and the plunger 40 cannot move to the extent necessary to place the end 54 in notch 96 and the clock can continue to run.

Further movement of actuator 36 will cause the tab 46' to enter the notch 94, at which time spring 78 will be stretched to its furthest extent. At the same time, tab 46' of plunger 40 will be removed from notch 91 in rotor 34 and the rotor will snap into a position wherein primer 42 will be directly in line with explosive train 44. As the plunger 40 continues to move, the end 54 of plunger 40 will reach the surface 97 on clock cam 38 which will allow further movement of plunger 40 and entry of cam 95 into the notch 90 on rotor 34. When the clock cam 38 has rotated to the position where end 54 is in the notch 98 of clock cam 38, tab 46' of plunger 40 will be entirely within the notch 94 of actuator 36 and the tab 95 will be entirely within the notch 90 of rotor 34 completely locking the system in an ARMED condition as shown in FIG. 2.

Figure 3:
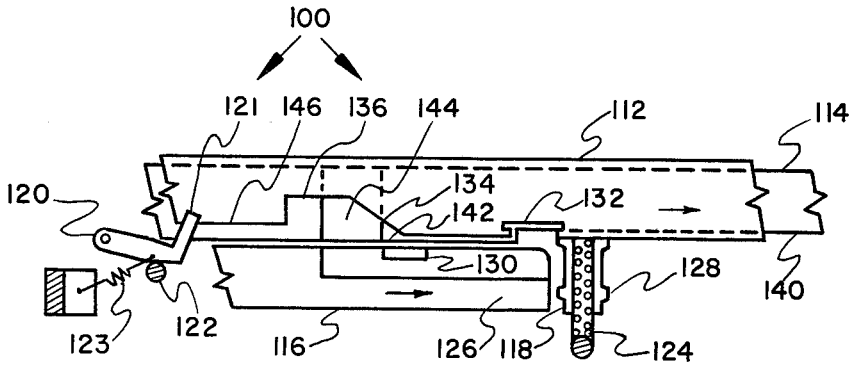
FIG. 3 is a linear representation of the elements of the logic module system according to the invention in a SAFE position prior to launch.

Turning now to FIG. 3, a linear system is generally indicated at 100. This system consists of a clock cam 112 movable under the influence of a stored energy means and under the control of a clockwork mechanism similar to that shown in FIG. 2. A cam actuator 114 is slidably situated alongside of clock cam 112 and is arranged to be moved by an environmental sensor such as shown at 32 in FIG. 2. A slide 116 which carries a primer (not shown) in a manner similar to rotor 34 in FIG. 2, is movable from a SAFE to an ARMED condition under the influence of energy stored by movement of actuator 114 in a manner similar to the device of FIG. 2.

Movement of slide 116 is prevented by plunger 118 unless a proper sequence of movement has been performed by clock cam 112 and actuator cam 114. Cams 112 and 114 are both locked against movement by a detent lock member 120 which has a tab 121 entering notches on both cams. Lock member 120 is retained in place by an arming wire or the like 122 and is biased to the unlocked position by a spring 123. Cams 112, 114 have a thickness and plunger 118 spans both thicknesses. Plunger 118 is biased against the surfaces of cams 112, 114 by a spring 124.

Movement of slide 116 to the right as shown in FIG. 3 is prevented by a raised surface 128 on plunger 118. Slide 116 also has a raised portion 130 designed to interfere with surface 128 of plunger 118.

Clock cam 112 has a notch 132 into which plunger 118 will enter if the clock mechanism precedes movement of actuator 114. However, if movement of cam 114 properly precedes movement of clock cam 112, the plunger will not move upward until it arrives at surface 134 of the clock cam and in a normal situation will come to rest on surface 136.

Actuator cam 114 has a first surface 140 which is recessed from the normal surface 142 and which will allow plunger 118 to move into the slot 132 of clock cam 112 if the clock cam sufficiently precedes movement of actuator 114. If cams 112 and 114 move in a normal manner, plunger 118 will be prevented from moving into slot 132 because of its contact with normal surface 142 of cam 114 and will not move upward until the groove 144 in cam 114 is presented in line therewith.

Figure 4A:
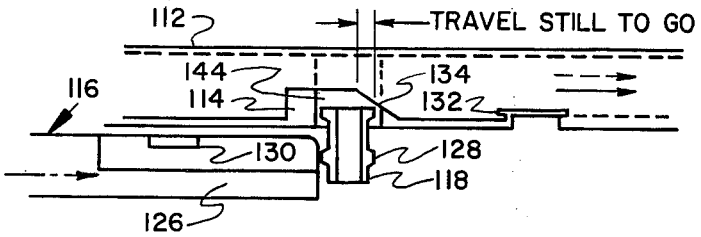
FIGS. 4*a*, 4*b* and 4*c* represent sequential operation of the device of FIG. 3 going from SAFE position to ARMED position.
Figure 4B:
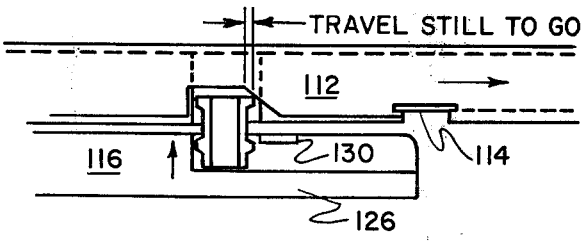
Figure 4C:
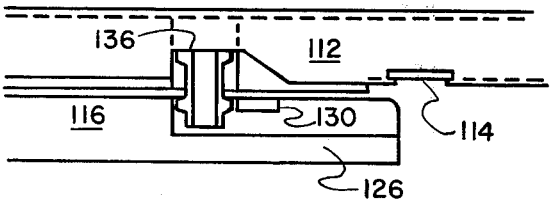

A normal sequence of events of cam operation is shown in FIGS. 4*a* through 4*c*. In FIG. 4*a*, for example, the plunger is shown in line with slot 144 and moving along surface 134 of the clock cam and the plunger has moved sufficiently upward to unlock the slide 116 for movement to the right as shown in this view.

In FIG. 4*b*, movement of plunger 118 is sufficient to begin locking action between surface 128 of plunger 118 and surface 130 of slide 116. The final position with all units locked in the ARM condition is shown in FIG. 4*c*.

Figure 5:
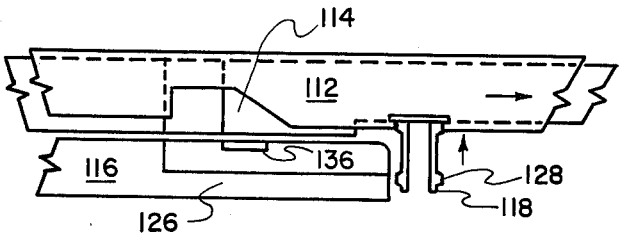
FIG. 5 is a view similar to FIG. 3 showing the position of elements when timer action precedes sufficient motion of the rotor actuator cam.

When the sequence of events are incorrectly presented the system will lock up in a SAFE or DUD condition. Thus in FIG. 5, the plunger has entered the slot 132 of clock cam 112 and the system remains locked in a DUD condition with the surface 128 blocking movement of slide 116.

Figure 6:
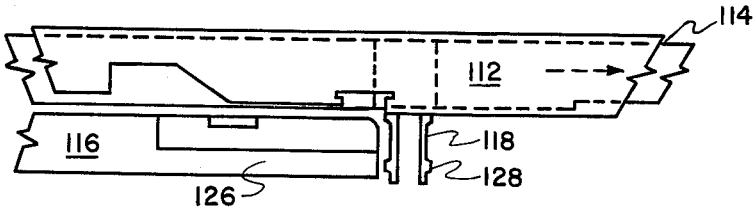
FIG. 6 is a view similar to FIG. 3 showing the elements in position when the rotor actuator cam precedes timer actuation.

If the clock fails to function, the actuator cam can go to ARM as shown in FIG. 6 but no movement of plunger 118 is possible because of its position on the clock cam.

Figure 7:
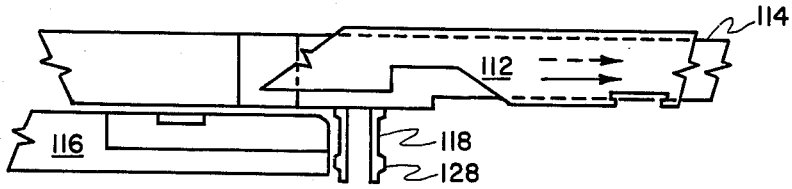
FIG. 7 is a view similar to FIG. 3 in which the elements indicate an overrunning of the timer cam.
Figure 8:
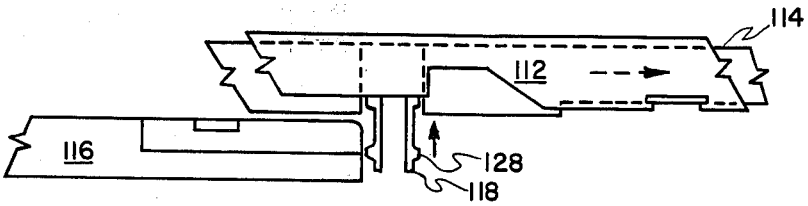
FIG. 8 is a view similar to FIG. 7 indicating a DUD lock situation following the sequence shown in FIG. 7.

If the clock movement greatly precedes the movement of the actuator cam as shown in FIG. 7, the eventual lockup will occur as shown in FIG. 8 with the plunger 118 moving into the slot 144 of cam 114 but resting on the surface 146 of clock cam 112.

Figure 9:
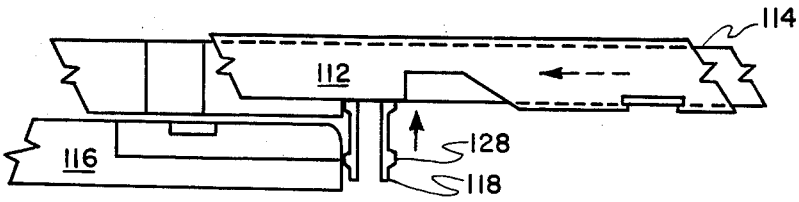
FIG. 9 is a view similar to FIG. 7 showing the position of elements when the rotor actuator reverses from the position shown in FIG. 7.

Should the energy output of the environmental sensor cause reverse motion of actuator 114, for example when the missile comes to rest, the plunger 40 will be locked by movement into contact with surface 140 as shown in FIG. 9.

What is claimed is:

1. A control mechanism comprising environmental sensing means having an energy output;

actuation initiation means;

time delay means;

first, second and third cam means movable from an initial position to a final actuation position;

plunger means coacting with said first and second cam means and movable from an initial position blocking movement of said third cam means;

said first cam means being driven under control of said time delay means from an initial position blocking movement of said plunger means to an actuation position allowing finite travel of said plunger means;

said second cam means being driven by energy developed by said environmental sensing means from an initial position blocking movement of said plunger means to an actuation position allowing full travel of said plunger means;

said third cam means carrying said actuation initiation means and being connected to said second cam means through an energy storage means;

said plunger means blocking movement of said third cam means until energy has been stored in said energy storage means;

whereby, when said first and second cam means move into the actuated position, said plunger will move into a position unlocking said third cam means and allowing said third cam means to move into the actuation initiation position;

said first cam means being provided with an overrun control surface coacting with a forward end of said plunger means and effective therewith to block actuation in the event movement of said first cam means precedes movement of said second cam means by a finite amount.

2. The control mechanism of claim 1 further including:

said plunger means having first and second contoured portions and an intermediate relieved portion; and said third cam means having first and second surfaces coacting with said contoured portions respectively of said plunger means;

so that said third cam means is initially prevented from movement by coaction of said first contoured surface of said plunger and said first surface of said third cam means; and said third cam means, when activated, is locked in actuated position by coaction of said second contoured surface of said plunger and said second surface of said third cam means.

3. A control mechanism comprising:

environmental sensing means having an energy output;

actuation initiation means;

time delay means;

first, second and third cam means movable from an initial position to a final actuation position;

plunger means coacting with said first and second cam means and movable from an initial position blocking movement of said third cam means;

said first cam means being driven under control of said time delay means from an initial position blocking movement of said plunger means to an actuation position allowing finite travel of said plunger means;

said second cam means being driven by energy developed by said environmental sensing means from an initial position blocking movement of said plunger means to an actuation position allowing full travel of said plunger means;

said third cam means carrying said actuation initiation means and being connected to said second cam means through an energy storage means;

said plunger means blocking movement of said third cam means until energy has been stored in said energy storage means;

whereby, when said first and second cam means move into the actuated position, said plunger will move into a position unlocking said third cam means and allowing said third cam means to move into the actuation initiation position;

said plunger means having first and second contoured portions and an intermediate relieved portion; and said third cam means having first and second surfaces coacting with said contoured portions respectively of said plunger means;

so that said third cam means is initially prevented from movement by coaction of said first contoured surface of said plunger and said first surface of said third cam means; and said third cam means, when activated, is locked in actuated position by coaction of said second contoured surface of said plunger and said second surface of said third cam means.

4. The control mechanism of claim 3 further including:

said first cam means being provided with an overrun control surface coacting with a forward end of said plunger means and effective therewith to block actuation in the event movement of said first cam means precedes movement of said second cam means by a finite amount.

* * * * *